United States Patent [19]

Lardellier

[11] 4,197,052

[45] Apr. 8, 1980

[54] SAFETY DEVICE FOR AN AXIALLY ROTATING MACHINE

[75] Inventor: Alain M. J. Lardellier, Melun, France

[73] Assignee: Societe Nationale d'Etude et de Construction de Moteurs d'Aviation, Paris, France

[21] Appl. No.: 947,546

[22] Filed: Oct. 2, 1978

[30] Foreign Application Priority Data

Oct. 11, 1977 [FR] France ..... 77 30485

[51] Int. Cl.[2] ..... F01D 21/00; F01D 25/24

[52] U.S. Cl. ..... 415/219 R; 415/9; 60/39.09 R

[58] Field of Search ..... 415/9, 219 R, 213 C; 60/39.09 R, 39.09 D; 74/609

[56] References Cited

U.S. PATENT DOCUMENTS

| | | | |
|---|---|---|---|
| 3,261,228 | 7/1966 | Rothman | 415/9 |
| 4,044,550 | 8/1977 | Vermilye | 60/30.09 R |
| 4,149,824 | 4/1979 | Adamson | 415/9 |

FOREIGN PATENT DOCUMENTS

| | | | |
|---|---|---|---|
| 1946085 | 3/1970 | Fed. Rep. of Germany | 60/39.09 R |
| 2404939 | 8/1974 | Fed. Rep. of Germany | 60/39.09 R |
| 868197 | 5/1961 | United Kingdom | 60/39.09 R |
| 1466385 | 3/1977 | United Kingdom | 60/39.09 R |

*Primary Examiner*—Leonard E. Smith

*Attorney, Agent, or Firm*—Bacon & Thomas

[57] ABSTRACT

A device to eject a fragment of a broken blade of an axially rotating machine by damping its kinetic energy, in order to prevent perforating the housing of the machine and the rupture of adjacent blades. The device is in the form of a helical ramp carried by the internal wall of the housing of the machine.

9 Claims, 5 Drawing Figures

SAFETY DEVICE FOR AN AXIALLY ROTATING MACHINE

BACKGROUND OF THE INVENTION

The invention concerns a device intended to prevent the dangerous consequences of the failure of a blade of an axially rotating machine, particularly the blower of an aircraft turbojet engine.

International regulations concerning the safety of aircraft are imposing severe technical limitations on engine and aircraft designers. They stipulate specifically that the fragments ejected as the consequence of the failure of a blade of a turbojet engine must be retained within the housing of the machine so that their radial ejection will not damage vital elements of the aircraft and risk injury to the passengers. For the engines of the first generation, the designers had to prove by means of experiments truly representative of operating conditions that the structure of the engine was capable of absorbing the kinetic energy of rotor fragments ejected as a result of the failure of a blade or disc. This requirement led to the provision of sheathing at the most critical rotor locations. This mode of protection is no longer adequate for advanced engines and particularly for the dual flow engines of the most recent generation. In the latter, certain blading has acquired large dimensions and thus a large mass. The kinetic energy of a broken blade has become considerable and the sheathing necessary to absorb it would have a prohibitive weight. Further, it has become absolutely necessary to prevent damage by a broken blade to two whole blades, because the imbalance would rapidly exceed the mechanical strength of the fastenings of the engine and the latter could be torn from its supports. In this respect, the rupture of a blade with a top bead in the turboblower which often forms the first stage of the compressor of a turbojet engine may prove to be particularly dangerous because of the mass and the mechanical strength of said blade.

SUMMARY OF THE INVENTION

The present invention is based on the results of experiments conducted on the bench employing recording by means of ultrahigh speed cinematography of the effects appearing immediately following the intentional failure of a blade. These experiments lead to the finding that the successive phenomena occurring between the tearing of the blade and the final catastrophy (for example, the breaking up of the engine) take place over a total period of several tens of microseconds, but that catastrophic phenomena occurs during the last milliseconds of this period. As an example, if said period consists of 50 milliseconds, no really dangerous phenomena takes place during the 40 milliseconds following the failure. Only during the last 10 milliseconds does the flying blade embed itself rigidly in the housing and obstruct rotation of the following blades, thus causing their successive rupture and finally the destruction of the engine.

It is the object of the invention to rapidly eliminate a broken blade or a fragment of a blade from the critical region, i.e. the blading zone.

According to the most succinct and consequently the most general definition, the device of the invention consists of a helical ramp arranged against the inner wall of the part of the housing surrounding the blading, the pitch of the spiral of the ramp being such that if a body ejected tangentially as the result of failure of a blade comes into contact with said inner wall, its rotation against said wall will cause it to be engaged by the ramp and deflected from the plane of the blades.

In a preferred embodiment, to facilitate the engagement, the ramp consists of a bar in relief (preferably machined out of the mass of the housing) with a width much less than the pitch of the spiral.

The angle of the spiral is calculated by taking into consideration the following two conditions: it must be sufficiently large so that the fragment of the blade will be deflected from the plane of the blading during less than one turn of the rotor or, in any case, during a period of time less than the period during which the fragment would become embedded in the housing. Simultaneously, care must be taken that the fragment of the blade does not acquire an axial velocity such that the resulting kinetic energy would be sufficient to produce great secondary damage.

A device intended to deflect a fragment of a broken blade from the plane of the blading has already been proposed. It consists of an annular recess machined in the internal wall of the housing and limited by a projection placed upstream from the blades, i.e. toward the air inlet. The detached fragment is supposed, because of its shape, to move toward said projection, restrained by the wall of the housing and broken by the impact of the intact blades into small pieces no longer dangerous, which are captured by the projection. However, such a device has serious disadvantages. On the one hand, the annular recess, because of its necessarily large radial depth, makes it impossible to satisfy the condition of tightness against leaks, required for reasons of efficiency by rotating machines (a compressor, for example). On the other hand, it may be envisioned that the detached fragment may damage the following blade of the rotor, when the fragments strike the blade, thus producing a phenomenon of accumulation which could hinder the deflection of said fragment from the plane of the blades. The device of the present invention eliminates these disadvantages. The helical ramp machined into the internal wall of the housing modifies only minimally the profile of said wall and consequently does not interfere with the role of leak barrier assigned to the tongues provided on the head of the blades. On the other hand, according to a very important operating characteristic the blade or fragment of a blade which has been detached, is guided forcibly, by a rail effect, out of the plane of the blading, by means of the helical trajectory of the ramp; this eliminates any risk of damage to the intact blades.

BRIEF DESCRIPTION OF THE DRAWINGS

Other features and advantages of the invention will be disclosed by the description followed by an example of embodiment with reference to the drawings attached hereto, in which.

DESCRIPTION OF THE PREFERRED EMBODIMENTS

Figure 1:
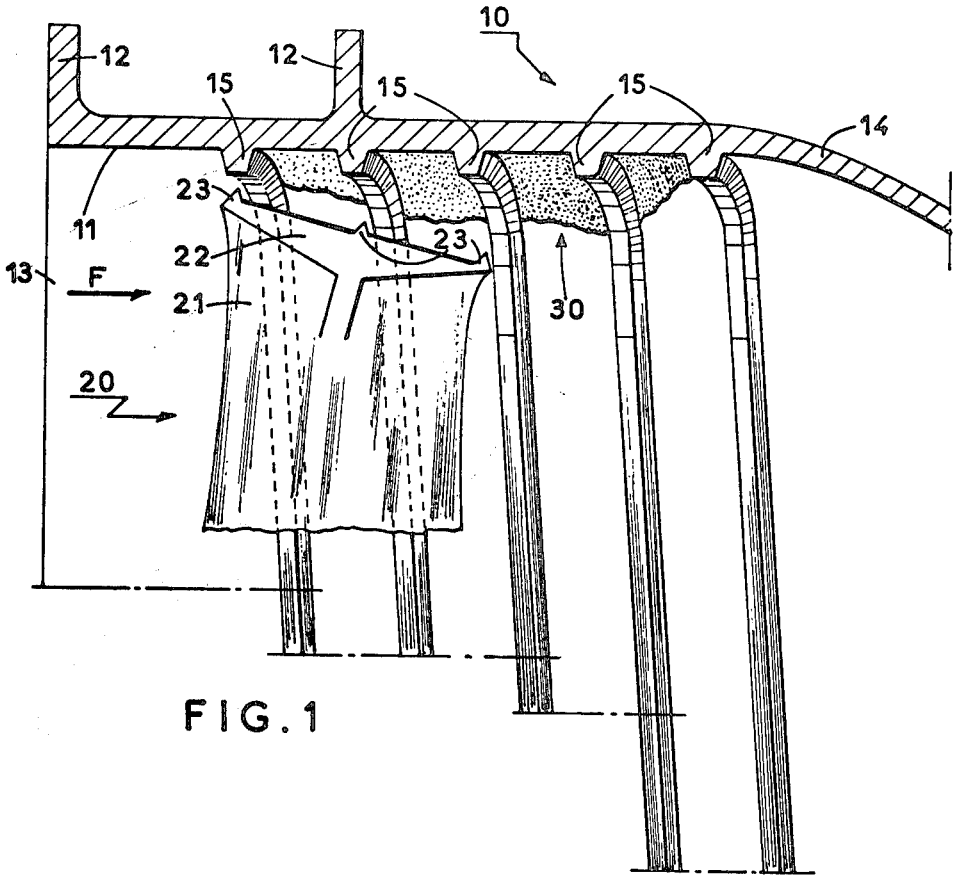
FIG. 1 is an axial section of a peripheral region of a stage of the blower of a turbojet engine, said stage comprising blading consisting of blades with top flanges and a housing equipped with the device of the invention.
Figure 2:
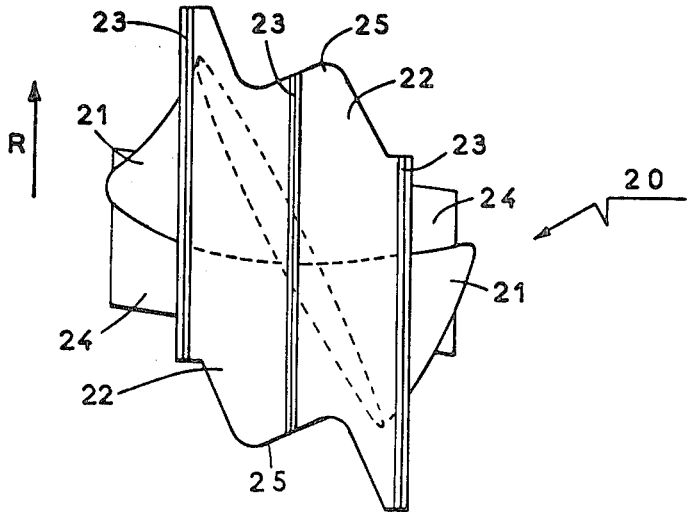
FIG. 2 is a top view of the blade, the end of which is shown in FIG. 1.

FIGS. 1 and 2 will be considered first, simultaneously. The arrow F of FIG. 1 and the arrow R of FIG. 2 indicate, respectively, the direction of the air flow and the direction of the rotation of the blades. FIG. 1 shows:

a peripheral region of the housing 10, with its internal wall 11, its fastenings 2, its air inlet 13 and the beginning of its connecting tube 14 with the subsequent stages, which are not shown. The fixed guide vanes which precede them and are also not shown:

the end of a blade 20, with a part of its air foil portion 21 and its flange 22;

an abradable layer 30 of a known type (agglomerate, or felt or sponge) attached to the internal wall 11 of the housing 10, occupying the annular space between the wall 11 and the ring formed by the head flanges such as 22 and extending downstream from the blading to the inlet of the connecting tube 14. Each flange 22 has known projections 23 oriented in diametrical planes, displaced from the location of the layer 30 by a distance sufficiently small so that during operation said projections trace grooves in said layer, thus forming tongues opposing return flow of part of the air flow along the periphery of the stage.

In FIG. 2, in addition to the air foil portion 21 of the blade 20, its flange 22 and the projections 23, the internal flange 24 is seen. The lateral flanks 25 of the flange 22 are designed so that they overlap each other with the corresponding flanks of the flanges of the adjacent blades, in a manner so that the head flanges of all of the blades form a continuous ring. The deflecting device of the invention consists, as shown in FIG. 1, of a helical rib 15 integral with the internal wall of the housing 10 and extending around and downstream of the blading. It is important to note that, in this embodiment, the pitch of the spiral of the band is "to the left", while, as indicated by the arrow R, the blades rotate, viewed from upstream, in the direct trigonometric direction.

Figure 3:
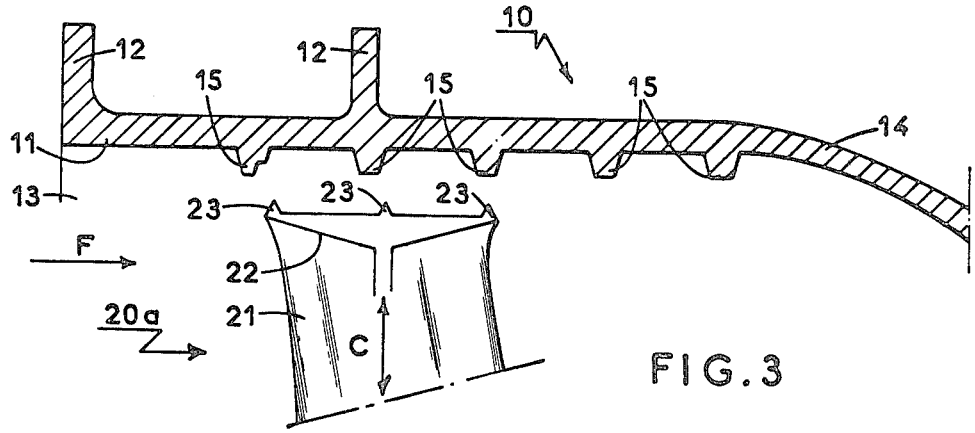
FIGS. 3, 4 and 5 are diagrammatic sections of the same area of the stage intended to show the positions successively taken by the blade of FIG. 1 after rupture, the section of each figure being taken in the axial plane occupied by the blade at the instant considered.
Figure 4:
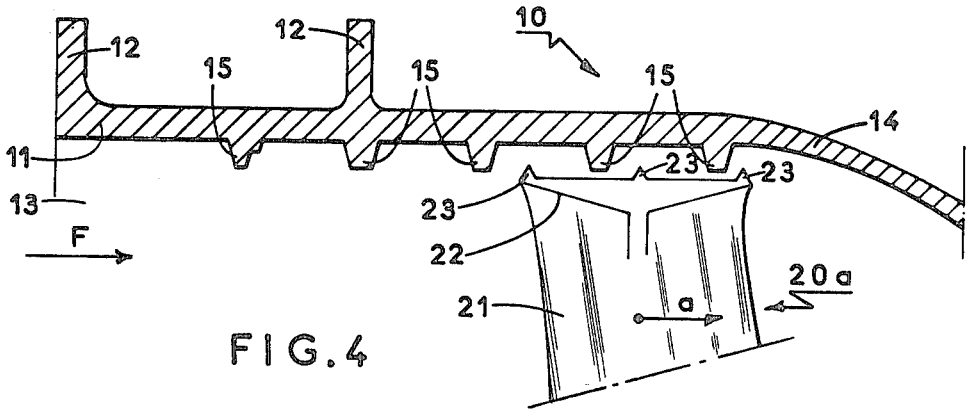
Figure 5:
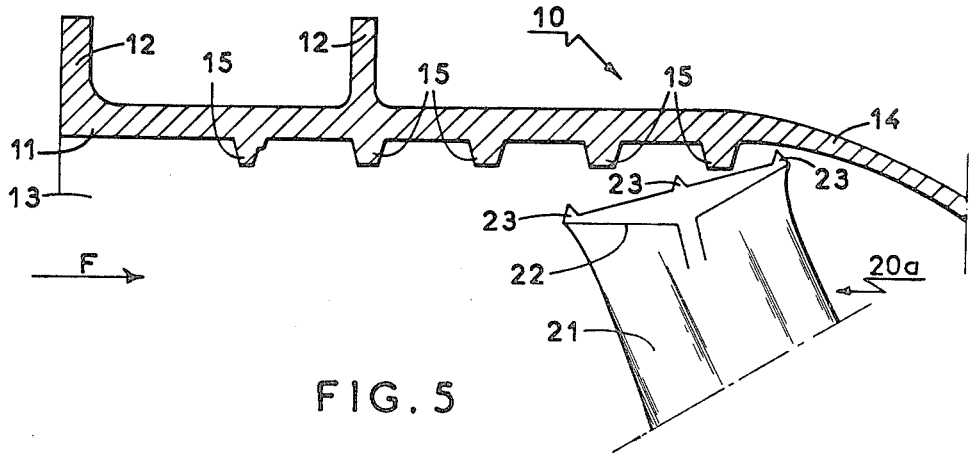

FIGS. 3, 4 and 5 will now be considered. They show only the outermost part of the blade fragment 20*a*, released by a fracture. It should be recalled that the FIGS. 3, 4 and 5 are all sections taken in the axial plane where said fragment is located during the various phases of deflection, i.e. they show the components of the movement of the fragment 20*a* in an axial plane, but not in a diametrical plane.

In FIG. 3, the fragment 20*a* is released after the fracture. The arrow "c" symbolizes the radial component of the entrifugal force acting upon it under the effect of its rotation caused by its inertia and by the force of the following blade, not shown. It should be understood that the layer 30 of FIG. 1 will be destroyed as soon as it is reached by the fragment 20*a*. For this reason, it is not shown in FIGS. 3, 4 and 5.

Under the effect of the rotation, the flange 22 of the fragment 20*a* is pressed firmly against the internal wall 11 of the housing 10 and the tongues 23 come into contact with the turns of the rib 15, which urge the fragment downstream. The axial component of the helical movement of the fragment 20*a* is indicated by the arrow "a" of FIG. 4, which shows the fragment at the moment of its removal from the zone of the blades.

Finally, in FIG. 5, the rotation of the fragment 20*a* has been stopped. It is braked by friction against the internal wall of the housing. However, the fragment is entrained by the flow of air in the downstream direction where it is arrested by the guide, not shown, of the following compression stage.

It is desirable that the fragment should escape from the blading zone after a single rotation. The pitch of the band 15 therefore must be equal at least to the width of the blading. But, because the head flanges have three projections 23 in the case shown, the deflection of the flange of the broken blade is more nearly assured if the intermediate projection is also engaged. The rib 15 of FIGS. 1 to 5 is thus double and actually forms a double spiral (15–15'), the pitch of each spiral component being approximately equal to the distance between the upstream and downstream projections. In a preferred embodiment, if each head flange comprises N number of equidistant projections forming tongues, the helical band will comprise N threads. On the other hand, the number of turns over which each simple spiral extends may correspond to a fraction of a turn, for example, a half turn or a turn and a half. This number is characteristic of each engine to be considered. In fact, given a value of the critical threshold of the angular trajectory corresponding to the total period mentioned in the introduction hereto, it is initially necessary that the fragment be able to engage the helical ramp regardless of the position of said fragment and it is necessary further that, during the time remaining as defined by the critical period, the fragment describe the trajectory required to deflect it from the plane of the blades. It may be readily understood that a head flange comprising a large number of projections forming tongues will effect its engagement in a very short period of time if the band of multiple spirals comprises N number of threads.

Certain numerical indications will be given hereinafter, solely as examples. Let the external diameter of the blading under consideration be 1730 mm and the width of the blading zone be 80 mm (the distance between the upstream and downstream projections being of the same order), the slope of the two spirals formed by the double band 15 is then approximately two degrees. For a circumferential velocity of the periphery of the blading of approximately 430 m/s, the axial velocity of deflection imposed by the rib is approximately 15 m/s. The kinetic energy of the fragment, because its rotation has been damped, is thus much below the dangerous level. However, said axial velocity is still sufficient for the period of retention of the fragment in the blading zone to be very short (approximately 5 m/s in the example considered) and much less than the 40 m/s at the expiration of which, as already indicated hereinabove, the risk of the destruction of the blading appears. In a general manner, these calculations simply indicate that for the majority of axially rotating machines, the slope of the helical band, determined as a function of the diameter of the blading, the width of the blade zones, and the permissible retention time of the debris, must be preferably between 1 and 4 degrees. It should be understood that the invention covers numerous variants capable of being applied to the figures described in detail hereinabove. Thus, for example, the helical ramp may be machined into the housing in the form of a groove of low longitudinal length. It may also be envisioned that the part in relief and the hollow part have equal longitudinal dimensions. Similarly, although it is generally desirable (as in the case of the figures detailed hereinabove) that the pitch of the spiral be such that the deflection of the blade fragment should be toward the rear of the engine (the action of the ramp will then largely counterbalance the aerodynamic reaction on the blade), it may prove advantageous, in certain cases, that the action of the pitch of the spiral be added to the aerodynamic reaction on the blade and thus aid the fragment in escaping toward the front.

I claim:

1. A device to prevent damage by the failure of a blade of the rotating blading of a stage of an axially rotating machine, particularly a blade with a head flange of the blower of a turbojet engine, said device consisting of a helical ramp arranged on the internal wall of the part of the housing surrounding the blading, the pitch of the helix being such that when the fragment of a blade ejected tangentially by the rupture of a blade comes into contact with said internal wall, its rotation against said wall will cause it to engage the ramp and be deflected from the plane of the blading.

2. A device according to claim 1, wherein said helical ramp consists of a rib, the width of which is appreciably less than the pitch of the helix.

3. A device according to claim 1 or claim 2, wherein the angle of the slope of the helix is between 1 and 4 degrees.

4. A device according to claim 3, wherein the angle of slope of the helix is approximately 2 degrees.

5. A device according to claim 3, wherein the pitch of the helix is approximately equal to the width of the blading zone.

6. A device according to claim 1, wherein the blades of the blading are of the head flange type with the juxtaposition of said flanges forming a continuous ring, each flange being equipped with at least one circumferential projection upstream and one circumferential projection downstream, each succession of projections playing the role of tongues, the pitch of the helix being approximately equal to the distance between said projections.

7. A device according to claim 6, wherein each flange is equipped with N number of equidistant projections, the ramp being in the form of multiple helixes with N threads, the pitch of each helix being approximately equal to the distance between the upstream projections and the downstream projections.

8. A housing for an axially rotating machine, wherein said housing includes a device as defined in claim 1.

9. A housing for a blower of a turbojet engine, wherein said housing includes a device according to claim 6 or claim 7.

* * * * *